US010794325B2

(12) United States Patent
Mlcek

(10) Patent No.: US 10,794,325 B2
(45) Date of Patent: Oct. 6, 2020

(54) HEAT ENGINE WITH A DYNAMICALLY CONTROLLABLE HYDRAULIC OUTLET

(71) Applicant: Jiri Mlcek, Zlin-Stipa (CZ)

(72) Inventor: Jiri Mlcek, Zlin-Stipa (CZ)

( * ) Notice: Subject to any disclaimer, the term of this patent is extended or adjusted under 35 U.S.C. 154(b) by 16 days.

(21) Appl. No.: 16/332,887

(22) PCT Filed: Sep. 13, 2017

(86) PCT No.: PCT/CZ2017/050040

§ 371 (c)(1),
(2) Date: Mar. 13, 2019

(87) PCT Pub. No.: WO2018/050134

PCT Pub. Date: Mar. 22, 2018

(65) Prior Publication Data

US 2020/0011271 A1 Jan. 9, 2020

(30) Foreign Application Priority Data

Sep. 13, 2016 (CZ) ..... PV2016-559

(51) Int. Cl.
*F02G 1/043* (2006.01)
*F04B 9/123* (2006.01)
*F04B 19/24* (2006.01)

(52) U.S. Cl.
CPC ..... *F02G 1/043* (2013.01); *F04B 9/123* (2013.01); *F04B 19/24* (2013.01)

(58) Field of Classification Search
CPC ..... F02G 1/043; F04B 19/24; F04B 9/123
See application file for complete search history.

(56) References Cited

U.S. PATENT DOCUMENTS 7,171,810 B2 * 2/2007 Conrad ..... F02G 1/0435 60/517
7,866,953 B2 * 1/2011 Johnston ..... F04B 43/073 417/228

(Continued)

FOREIGN PATENT DOCUMENTS

CN 103883425 A 6/2014
CN 103883425 B 10/2015

(Continued)

OTHER PUBLICATIONS

International Search Report dated Feb. 28, 2018 for International Application No. PCT/CZ2017/050040 filed Sep. 13, 2017.

*Primary Examiner* — Shafiq Mian
(74) *Attorney, Agent, or Firm* — Blue Filament Law PLLC

(57) ABSTRACT

A heat engine with a dynamically controllable hydraulic outlet driven by a high-pressure pump and a gas turbine that include a pressure vessel (1), a lid (1.1), a movable partition (2), a gas working space (4), a liquid working space (5), and a recuperator (7), wherein a sealing (1.4) is disposed between the pressure vessel (1) and the lid (1.1), wherein in the inner space of the pressure vessel (1) the partition (2) is movably attached to a folded membrane (3) which is attached to the lid (1.1), wherein the partition (2) divides the inner space of the pressure vessel (1) into the gas working space (4) and the liquid working space (5), and shaped parts (1.8) are arranged within the pressure vessel, which define an external gas channel (10) which is led between a shell of the pressure vessel (1) and the shaped parts.

9 Claims, 12 Drawing Sheets

(56) References Cited

U.S. PATENT DOCUMENTS

| | | | | |
|---|---|---|---|---|
| 2002/0073703 | A1 | 6/2002 | Bailey | |
| 2012/0159943 | A1* | 6/2012 | Steiner | F02G 1/053 60/526 |
| 2016/0215684 | A1* | 7/2016 | Hofmann | F04B 45/04 |

FOREIGN PATENT DOCUMENTS

| | | | |
|---|---|---|---|
| DE | 865458 | C | 2/1953 |
| GB | 2077367 | A | 12/1981 |
| JP | H05223271 | A | 8/1993 |
| WO | 8200319 | A1 | 2/1982 |
| WO | 8400399 | A1 | 2/1984 |
| WO | 0004287 | A1 | 1/2000 |
| WO | 02070887 | A1 | 9/2002 |
| WO | 2006044387 | A2 | 4/2006 |

* cited by examiner

HEAT ENGINE WITH A DYNAMICALLY CONTROLLABLE HYDRAULIC OUTLET

FIELD OF THE INVENTION

The invention relates to a heat engine with a dynamically controllable hydraulic outlet driven by a high-pressure pump and a gas turbine designed for working activities where rectilinear action of large forces is required.

BACKGROUND OF THE INVENTION

Heat engines use a cyclic process where the energy of a supplied substance is transformed into kinetic energy, The torque characteristic of the heat engine energy output may not always be suitable for direct use thereof, so we adjust it to meet the needs in practice. For this purpose, we utilize the so-called interface for power transmission. Hydraulic systems for power transmission are currently commonly used for machine drive and work activities, where rectilinear action of large forces is required.

In current practice of the art, high-pressure pumps use the most common rotary machines, such as an electric engine, as the drive source. With higher power and special applications or without an available electrical energy source, an internal combustion engine or turbine is available as a drive.

One embodiment of a heat engine used as an electrical energy source for a high-pressure pump, entitled HEAT ENGINE WITH HYDRAULIC OUTPUT, is described in WO02070887. The hydraulic system according to the present invention is configured and constructed in such a way that repeated piston induced pressure surges serve to pump hydraulic liquid and to transform mechanical energy of the hydraulic liquid flow into a linear or rotary motion. Thermal energy for operation of the present engine is obtained from hot flue gases. In a basic embodiment, a heat engine shell is used to transfer heat from hot flue gas to the working gas. In the engine shell, from a side of hot flue gases as well as a side of the working gas inside the engine, lamella ribs are arranged as to transfer heat from the hot flue gases to the working gas. The working gas is hermetically sealed within the heat engine in a working chamber, resiliently separated from a main pump chamber containing the hydraulic liquid. The working chamber is divided into two parts, upper and lower, by a displacer. The displacer is connected to a shaft coupled to an electric engine immersed in the hydraulic liquid in the main pump chamber. The displacer divides the working chamber into two parts, an upper and a lower one. Due to the upward and downward cyclical movement of the displacer, the volume of the upper and lower portions of the working chamber alternately changes, preferably so that at one stage the volume of one of the working chamber parts is minimal and the volume of the other working chamber part is maximal. The working gas entering into and exiting out of the top of the working chamber arranged above the displacer is led past the heat engine shell. Here, hot flue gases pass the heat energy to the working gas. In the phase of the maximum working gas volume at the top of the working chamber, the volume and the pressure in the entire working chamber are maximal. Expansion of the working gas exerts pressure on the hydraulic liquid in the main pump chamber, which is subsequently forced out of the main pump chamber by the pipeline. Hydraulic liquid flows from the pump chamber through the pipeline, reversing valve, and heat exchanger into a first container. From the first container to the output working unit arid through the pipeline to the second container, from Where it flows back through another reversing valve arid the cooling portion back into the main chamber of the pump. An accumulator maintains the system pressure higher than the pressure in the engine so that the pressure drop in the pump chamber does not stop the flow of the hydraulic liquid through the reversing valve when the displacer moves upwards. The containers size and piping diameter throughout the entire hydraulic system must be large enough to allow the necessary hydraulic liquid flow to drain energy from the engine to the output unit. In an embodiment with a hydraulic pump employing periodic hydraulic liquid pressure surges as a power source, the hydraulic liquid is pumped tangentially at the inlet, and either tangentially or axially at the outlet. In this embodiment with a pump, the hydraulic liquid enters into the pump through a tangential inlet and flows through a spiral path to the bottom part of the pump where is located the pump outlet. The reversing valve might be used at the liquid inlet or outlet from the pump to maintain the unidirectional flow of the pump. In an embodiment of the heat engine with a hydraulic pump with axial output, the hydraulic liquid enters the pump through the lower part of the pump, where it further flows into the three-dimensional elbow, which provides the flow through the spiral path to the tangential outlet. This embodiment entails a structural limitation in dependence between pressure and velocity of liquid flow through the engine. Dynamic output control for these solutions is not possible.

The Stirling engine, useful as a heat pump, is described in WO8200319. In this embodiment, a working vessel is filled with a Working gas-helium, the vessel is heated at the lower end and cooled at the upper end thereof. The vessel contains a displacer that is flexibly attached to the working vessel. The displacer displaces the working gas from one side to the other, inside the working vessel, for alternate heating and cooling of the working gas. The vessel is closed by a flexible membrane, which bends under pressure waves generated in the vessel. As the membrane bends, it displaces hydraulic liquid in the hydraulic chamber and drives a servomotor for controlling the linear alternator and the gas compressor.

Patent No. CN 103883425 B discloses a hydraulic transmission of a Stirling engine with a heat reservoir as a heat source. The engine includes a heat container in an outer shell, a heating element, a heat exchange system, an air inlet, a heat storage element, a Stirling engine hydraulic transmission element, hydraulic pipeline, a hydraulic system liquid reservoir, a hydraulic engine and a hot air duct. The element of the Stirling engine hydraulic gearing is of the two-step type.

U.S. Patent Application No. US2002073703 A discloses a system without a piston engine, particularly for motor vehicles. The system includes at least one hydraulic pump, each of which is provided with a first and a second liquid passage. The internal combustion engine without a piston includes a combustion cylinder and a hydraulic cylinder. A low-pressure accumulator is connected to the hydraulic cylinder via a liquid. A first control valve connects the low-pressure accumulator with the hydraulic Cylinder. At least one high-pressure accumulator is connected to the hydraulic cylinder via the liquid, wherein said connection is provided with at least one second control valve. A third control valve interconnects the hydraulic cylinder with the first liquid channel of each pump. A fourth control valve connects the hydraulic cylinder with the second liquid channel of each pump. The first working pressure vessel is connected between each pump and the third control valve or the fourth control valve.

WO8400399 A discloses a heat engine having a displacer movable between a hot end and the cold end of a working chamber in which is disposed a working piston driven by a working liquid. A hydraulic liquid working piston pump and a hydraulic control valve are connected to a hydraulic outlet pipeline so that the said valve can regulate the hydraulic liquid flow. The working piston can be controlled using a control unit independently of the displacer movement.

International Patent Application WO 0004287 A discloses a motion generator having a housing and a chamber containing an incompressible liquid. An opening in the housing is enclosed by a movable element. Opposing convex, flexible walls in the housing form an internal modulation chamber containing compressible gas. The opposite ends of the walls can be moved towards each other and apart from each other by means of a movement converter, e.g., ceramic piezoelectric members, for compressing and depressing the chamber, thereby moving the movable element and generating the output motion. Patent application WO 2006044387 A discloses a pump for pumping liquid from a first low pressure source into a second high-pressure liquid source, wherein the pump comprises a chamber. A divider member is movably positioned in the chamber and divides the chamber into a first and a second sub-chambers of different volumes; The first sub-chamber has an opening controllably connected to either a second liquid source or a third liquid source. The second sub-chamber has inlet and outlet openings controllably connected to the first and second liquid sources. The pump further includes a cooling device for cooling the liquid in the first sub-chamber.

Hydraulic power transmission generally involves changing the mechanical work of an engine to potential or kinetic energy of a liquid. These hydraulic systems are made up of three basic parts, a high-pressure pump, a liquid flow control system and a hydraulic drive, or an engine. In the hydraulic system according to this embodiment, pressure surges can be generated in the course of controlling the hydraulic liquid flow due to inertia and practical incompressibility of the hydraulic liquid. Removing these phenomena requires a technically demanding and costly solution. Pressure losses caused pipeline distribution, hydraulic liquid flow control and pressure surges reduce the efficiency and lifetime of the entire system.

Heat engines with external sources of thermal energy have previously appeared in technical practice. With technical improvement of combustion engines, the advantages of heat engines with external heat sources did not overcome the structural difficulties of their existing solutions. Problems in technical practice are mainly caused by mechanical power output from a device with permanent internal overpressure and the need for mechanically highly loaded internal movable parts. Insufficient provision of operational reliability, hermeticity and easy service, prevent the use of this type of engine in technical practice.

The present invention aims to design a device with a dynamically controllable thermal energy transmission to a high-pressure hydraulic liquid output. Such a device is a heat engine with a hydraulic outlet, one liquid chamber and one working chamber filled with gas, wherein the movement of the gas in the working chamber can be controlled by means of a pneumatic actuator.

SUMMARY OF THE INVENTION

The above mentioned drawbacks are eliminated by a heat engine with a dynamically controlled outlet, driven by a high-pressure pump and a gas turbine comprising a pressure vessel, a lid, a movable partition, a gas working space, a liquid working space, and a recuperator, the principle of which consists in that it comprises the pressure vessel with the lid, between which there is arranged a seal, wherein in the inner space of the pressure vessel the partition is movably attached to a membrane which is further attached to the lid, wherein the partition divides the inner space of the pressure vessel into the gas working space and the liquid working space, wherein the gas working space occupies a larger area thereof, wherein said gas working space is surrounded by a first permeable membrane in the area of the first partition, by a folded permeable membrane on its circumference, and by a second permeable membrane at the point of the recuperator connection, and further, shaped parts are arranged within the pressure vessel which define an external gas channel which is located between a shell of the pressure vessel and the shaped parts, while a circumferential gas channel is located between the shaped parts and the folded permeable membrane and further between the partition and a first permeable membrane, wherein the gas working space is filled with a microstructure of large porosity, reinforced by meshes. The filled gas working space is connected via the second permeable membrane to a recuperator in the space of which is arranged an exchanger connected to the heat energy source, wherein the recuperator is further surrounded by the shaped parts, the external gas channel is fed into the recuperator on the opposite side of the gas working space inlet, which external gas channel is connected to a pneumatic actuator chamber, into which is fed the inner gas channel, connected to the circumferential gas channels and further to the folded permeable membrane and the permeable membrane surrounding the gas working space.

This is an embodiment of a gas heat engine where the working gas is hermetically sealed in the gas working chamber of the pressure vessel. Its heat/volume/pressure changes are performing work.

The principle of the present invention is to replace the mechanical displacer with a pneumatic actuator and therefore there is no need to separate the hot and cold parts of the working space. Originally, the working space divided into hot and cool parts by the displacer is designed as a single working chamber in the inventive embodiment. This workspace is filled with a microstructure of high porosity and thus with a minimum volume weight. The microstructure must withstand a gentle pressure of the gas flowing through the space filled in this way. In order to maintain such a microstructure on a larger scale, it is interlaced by meshes of reinforcing fibres in layers, in a plane perpendicular to the direction of the bulk changes of the gas working space. The mutual distances of the mesh and mesh fibres will depend on the desired dynamics of the working gas flow within the workspace. These distances range in the order of 100 to 10,000 times the mean distance of the microstructure elements.

This microstructure significantly reduces the possibilities of convective and radiation propagation of heat within the gas working space. At the points of gas inlet and outlet to the gas working space there are membranes with impeded gas permeability. These membranes ensure a uniform flow of the working gas into the gas working space and minimize, along with the microstructure inside the gas working space, the turbulent mixing of cold and hot gas. The microstructure may have different bulk densities at different locations of the gas working space. In this way, resistance to the passage of the working gas through this microstructure can be determined locally, and the direction of spreading of the working gas in the gas working space can be determined as well, so as to make full use of its maximum volume for changes in the physical parameters of the working gas. The gas working space is filled and emptied from one side or from the centre by a higher temperature gas, and from the other side or from the circumference it is filled and emptied by a lower temperature gas. The movement of the gas within the microstructure by eliminating turbulent flow on a larger scale will at the same time create a dynamically moving zone with a high temperature gradient at the interface between the higher temperature working gas and the lower temperature working gas. This zone will move and change due to a change in the flow of the working gas controlled by the pneumatic actuator. Regulating the flow in the gas workspace will aim to minimize the exposure to temperature changes of the portion of the gas working space with higher mass and hence even the thermal capacity, ideally only the microstructure and mesh fibres. It is preferable, that the absence of a mass displacer in the gas working space allows for any rapid change in the average temperature and thus in the pressure/Volume of the working gas in the gas working space. By pressure bonding the gas working space with the liquid working space, this change of pressure/volume immediately occurs in the liquid working space. This change in average temperature is made possible by filling and at the same time emptying the gas working space through the cooling and heating heat exchangers and the recuperator. The dynamics of the change is given by the velocity of this flow, which is due to the pressure difference created by the pneumatic actuator. This pressure difference created by the pneumatic actuator is determined not only by its rotational speed, but also by the impeller setting in the pneumatic actuator chamber against a pair of bi-directional gas channels. Increasing or decreasing the average temperature and thus the pressure and volume in the gas working space and thus the pressure throughout the entire engine is given by the direction of the internal flow of the working gas. The movement of the working gas in the gas working space can be precisely controlled by means of a pneumatic actuator; it is necessary to ensure that the effects of the gas flow within the gas working space never exceed the limit when irreversible compression or collapse of the microstructure or mechanical damage to the other parts occur. It is further necessary to ensure that the working gas temperature inside the workspace does not exceed the temperature resistance limit of the microstructure and other parts of the equipment.

The main disadvantages of the prior art are addressed by the principle of unification of the drive and control parts of the hydraulic system. The solution conceived in this way will greatly reduce the possibility of pressure surges in the drive and control hydraulic system. The engine is considerably simpler in design and does not contain any significantly mechanically loaded parts in the part with the permanent high pressure. In the case of the use of a magnetic bearing with a pneumatic actuator, there is no interference between the movable parts inside the heat engine, which has a significant effect on its reliability and service life. In hydraulic applications with high dynamics of pressure changes, this heat engine will provide a solution with a dynamic that had not been allowed by existing systems. Other parameters, such as the weight-performance ratio, dramatically improve due to a lower load in pressure surges in the hydraulic system and due the possible absence of regulatory elements. Due to the potentially short, unlimited connection to the hydraulic engine/drive, a significant reduction in system pressure drops can be expected and therefore even an increase in overall efficiency, especially for hydraulic systems with high dynamics of pressure changes. Since the energy source for this embodiment is thermal energy, the choice of power source is much wider than with existing hydraulic systems. At the same time it allows for the use of alternative and renewable sources of heat and energy. With cyclical changes in optimal mode, the hydraulic output of the device can be used directly as a pump. Preferably, the device will operate at high pressures where higher power can be achieved by increasing the pressure in the same workspace.

Inappropriate operational reliability, hermeticity and ease of servicing, common with existing design solutions, are resolved in the newly designed device. High reliability is provided by the design of the device allowing for complete encapsulation without the need for sealing at the point of movement. Inside the heat engine there are no highly mechanically loaded parts and there is no need for mutual contact of the moving parts, therefore lubrication is not necessary, which has a major effect on the life of these parts, and therefore a highly pressurized part of the device in a permanent hermetic design without the need for regular maintenance and replacement of the internal parts or liquids is possible.

BRIEF DESCRIPTION OF DRAWINGS

The invention will be explained with reference to the accompanying drawings, where.

DESCRIPTION OF AN EXEMPLARY EMBODIMENT

The present invention will be explained in the following description of an exemplary embodiment of a heat engine with a dynamically controllable hydraulic output with reference to the corresponding drawings. In the present drawings, the invention is illustrated by means of an exemplary embodiment of a heat engine with an internal heat exchanger and a heat engine with a heating heat exchanger in the pressure vessel shell.

Figure 1:
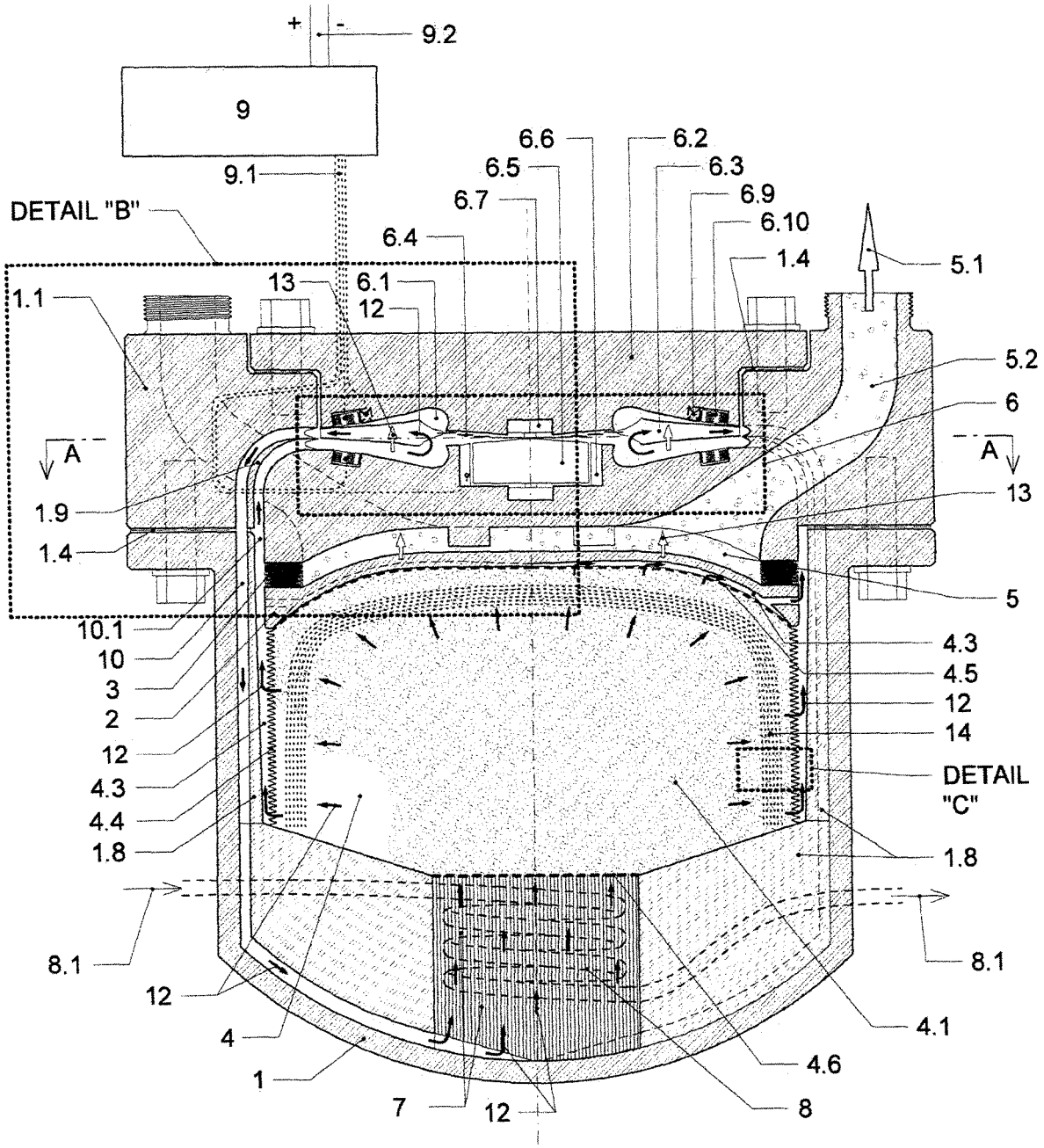
FIG. 1 illustrates an exemplary embodiment with an internal exchanger in the expansion phase.
Figure 2:
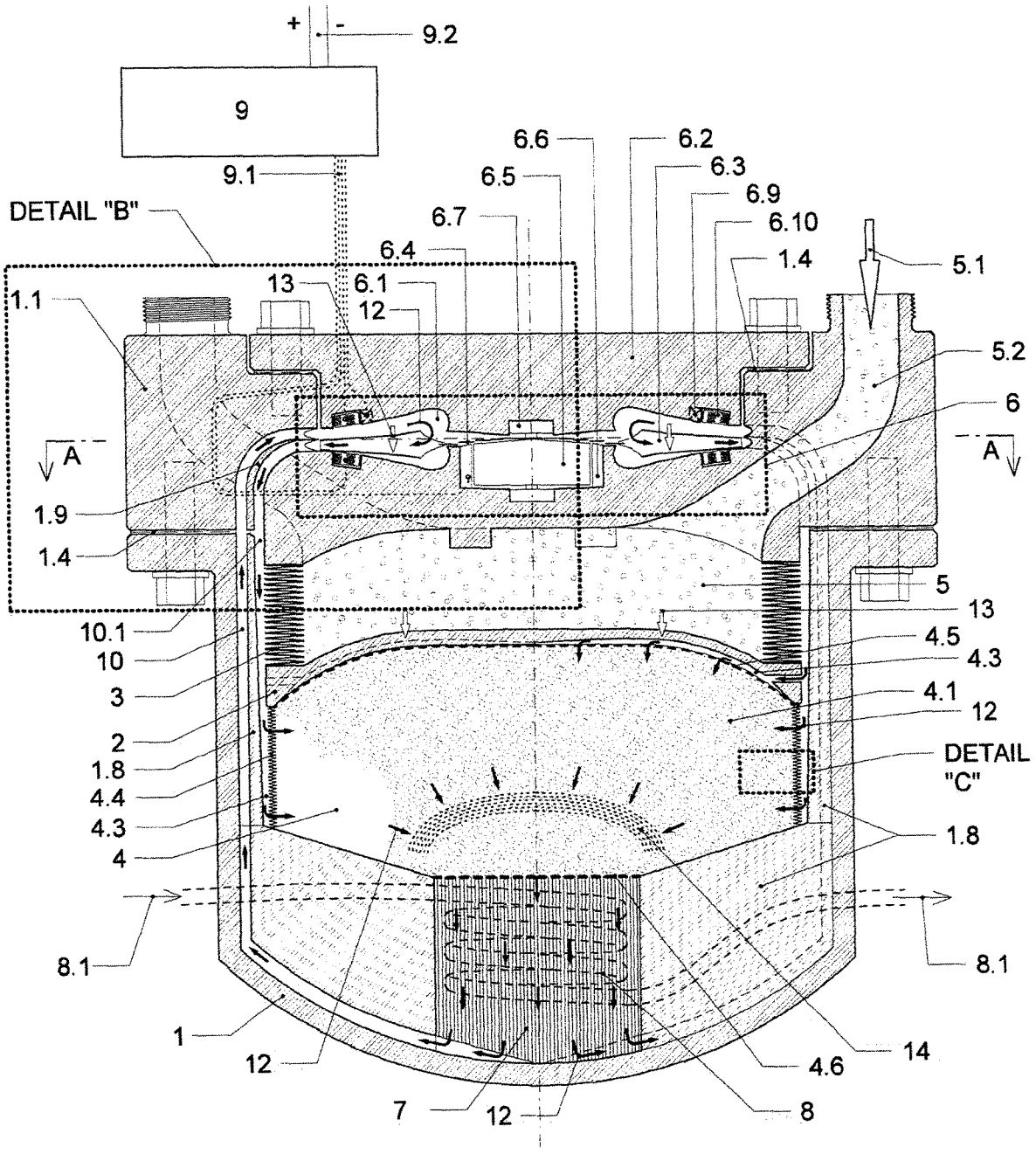
FIG. 2 illustrates an exemplary embodiment with an internal exchanger in the compression phase.

The heat engine with an internal heat exchanger is shown in FIGS. 1 and 2. In this embodiment the heat engine consists of a pressure vessel 1 and a lid 1.1 between which a seal A A is arranged. The pressure vessel 1 is in cylindrical shape and is optimal from the perspective of volume compactness and internal pressure, wherein such a container shape is not a prerequisite for the correct operation of the apparatus. The pressure vessel 1 is. further divided by a partition 2 into Iwo working spaces. These are a gas working space 4 and a liquid working space 5, into which is fed a liquid channel 5.2, which is terminated by a hydraulic inlet/outlet 5.1, serving to discharge the mechanical work from the heat engine. The gas working space 4 occupies a larger portion of the pressure vessel 1, its optimal shape is compact, similar to ball with the smallest surface relative to the volume, wherein this gas working space 4 is surrounded by a first permeable membrane 4.5, a folded permeable membrane 4.4 and a second permeable membrane 4.6. In addition, shaped parts 1.8 are provided within the pressure vessel I which define the external gas channel 10 which is located between the shell of the pressure vessel 1 and the shaped parts 1.8; while the circumferential gas channels 4.3 are located between the shaped parts 1.8 and the first permeable membrane 4.5, partition 2, folded membrane 3 and folded permeable membrane 4.4. In order to ensure an arranged and definable movement 12 of the working gas and to minimize the temperature changes of the working gas due to chaotic flow, heat radiation and conduction within the gas working space 4, it is filled with a microstructure 4.1 This microstructure 4.1 consists of a material resistant to cyclic temperature changes in the engine temperature range and has sufficient resilience and strength within this temperature range. The microstructure 4.1. has porosity greater than 99% based on its total volume, with a density of from $1\times10^{-4}$ to 0.03 g $cm^3$. Uniformity and the method of joining individual elements in the microstructure 4.1 must allow for volumetric changes without permanent deformation and with a high service life. Suitable materials for making the microstructure 4.1 are carbon, ceramic and metal micro and nanofibres, aerographite, graphite aerogel or other materials meeting the abovementioned conditions of material properties.

Figure 10:
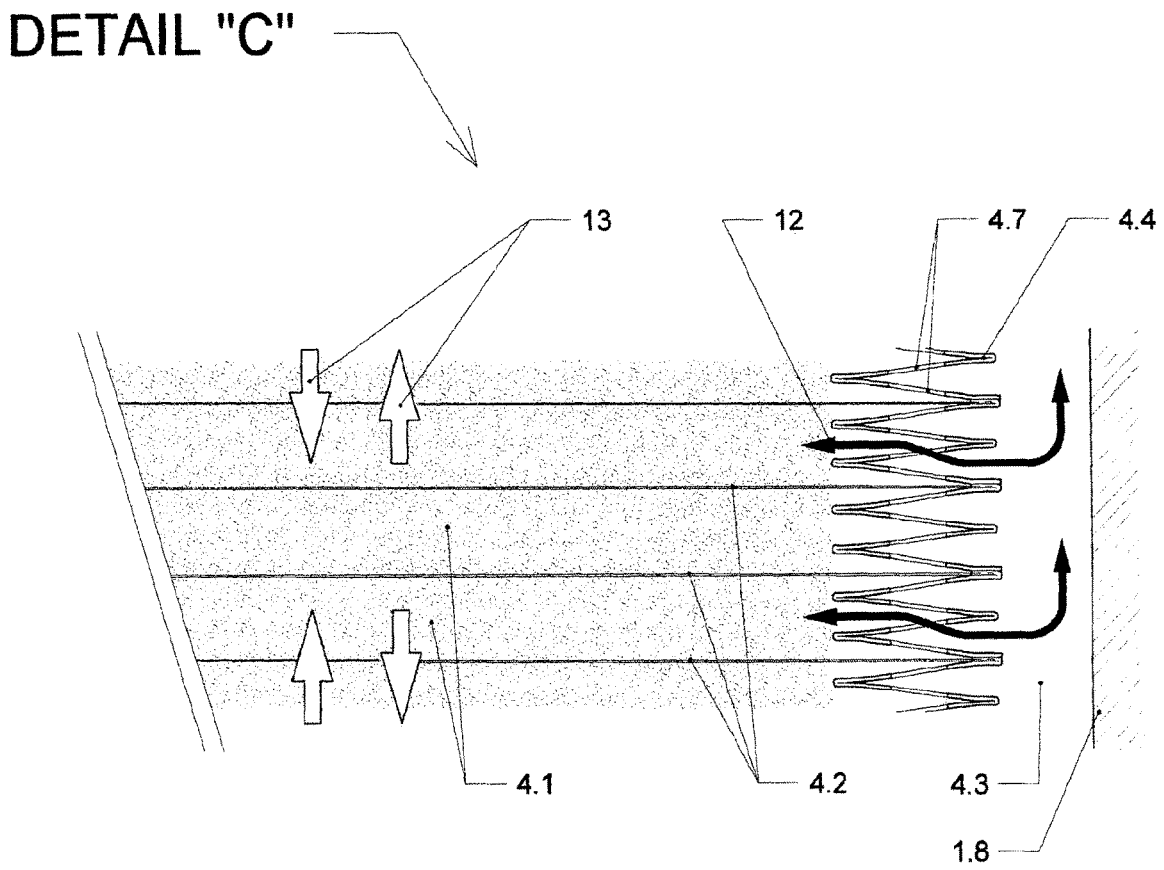
FIG. 10 illustrates a detail "C" of the embodiment of the filling of the working space.
Figure 11:
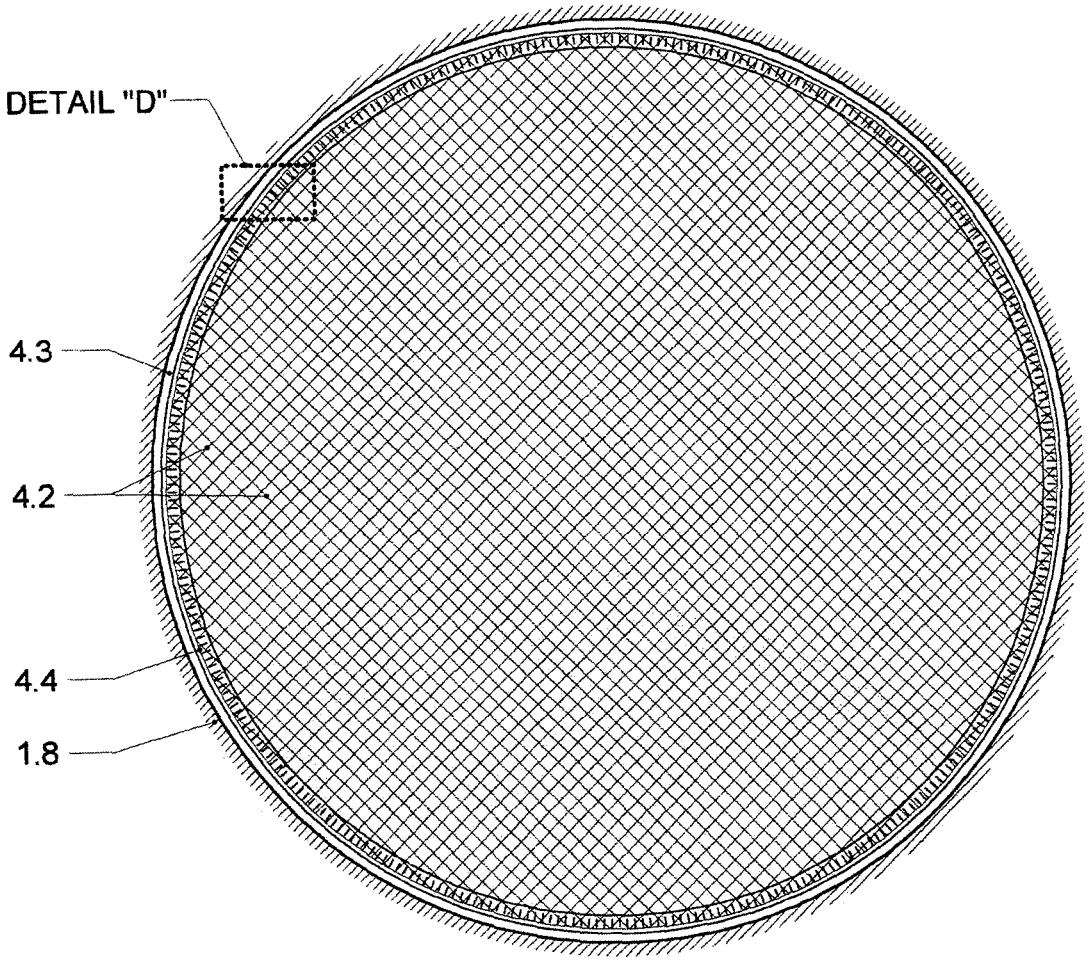
FIG. 11 illustrates; an exemplary embodiment of the mesh.
Figure 12:
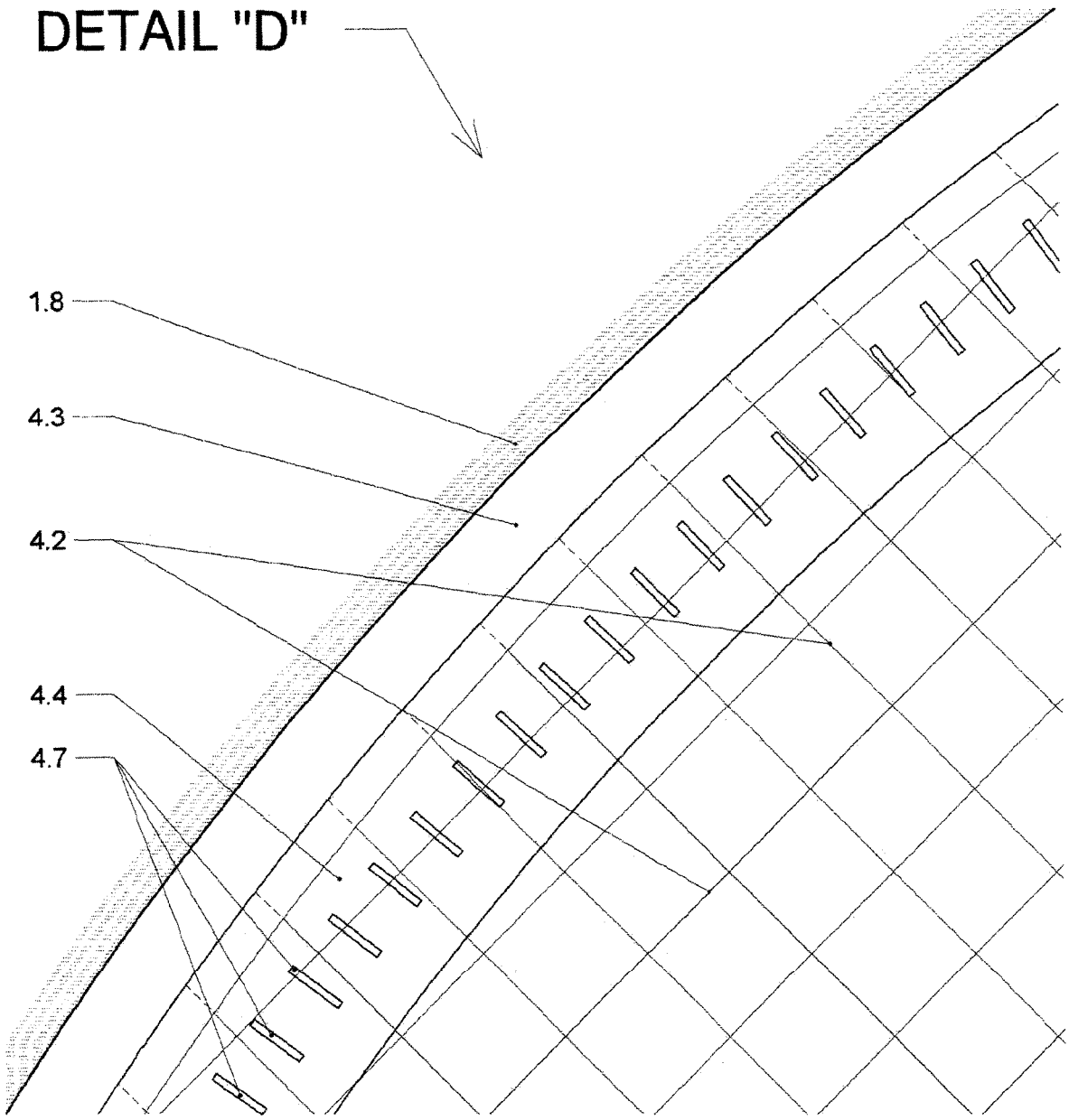
FIG. 12 illustrates a detail of the "D" embodiment of the mesh edge fastened to the folds of the folded permeable membrane.

This microstructure 4.1 can be reinforced by meshes 4.2 spaced apart from each other, wherein the meshes 4.2 are oriented perpendicularly to the direction of dimensional changes of the gas working space 4 during the working phases. The meshes 4.2 are formed by intertwined fibres within a ring having a "V" or "W" shape turned by 90°. The fibres in the form of a netting can be attached to the rings by soldering, gluing, pressing into the edge of one ring or between two rings, or by inserting between two rings before welding. The rings and therefore the folded permeable membrane 4.4 are made of thin metal plate with high elasticity and fatigue resistance; the ideal material is alloy steel or titanium alloy. The rings are provided with holes 4.7 on the circumference, which provide for the folded permeable membrane 4.4 assembled from these rings its permeability to the working gas; see FIG. 10 and FIG. 12. The spaces between the meshes 4.2 are filled with the microstructure 4.1. The purpose of the meshes 4.2 is to maintain the uniform microstructure 4.1 both in the changes in the volume of the gas working space 4 and in the internal movement 12 of the working gas. The arrangement of the meshes 4.2 and the microstructure 4.1 within the gas working space 4 is illustrated in FIG. 10 and FIG. 11. FIG. 12 illustrates a detail "D" of the embodiment of the edge of the folded permeable membrane 4.4. For high temperature applications, the mesh 4.2 fibres could be made of carbon, ceramic or metal.

The design of both the gas working space 4 and the liquid working space 5 must allow movement of the partition 2, which separates them. The design of the partition 2 and the folded membrane 3 is designed to withstand the pressure in the gas working space 4 even after the liquid has been discharged from the liquid working space 5. The folded membrane 3 forms at the same time a heat exchange surface between the working gas flowing in the internal gas channel 10.1 and the hydraulic liquid within the liquid working space 5, forming a second heat exchanger. In this part of the circumferential gas channel 4.3, the working gas will be conducted so as to maximize the heat exchange between the working gas and the folded membrane 3. The flow of the working gas in one phase (in the other one vice versa) will be conducted from the chamber of the pneumatic actuator 6 to the internal gas channel 10.1, then in this part of the circumferential gas channel 4.3, then to the permeable membrane 4.5 and the folded permeable membrane 4.4 into the gas working space 4 and into the recuperator 7, in which a heat exchanger 8 is disposed, which is connected to the inlet 7 outlet 8.1 of the heat transfer medium, the working gas is further passed through the external gas channel 10 to the chamber 6.1 which is a part of the pneumatic actuator 6. Structurally it is necessary to ensure best possible ratio between the volume of the gas working space 4 and the volume of the other parts of the heat engine in which the working gas is located.

Figure 3:
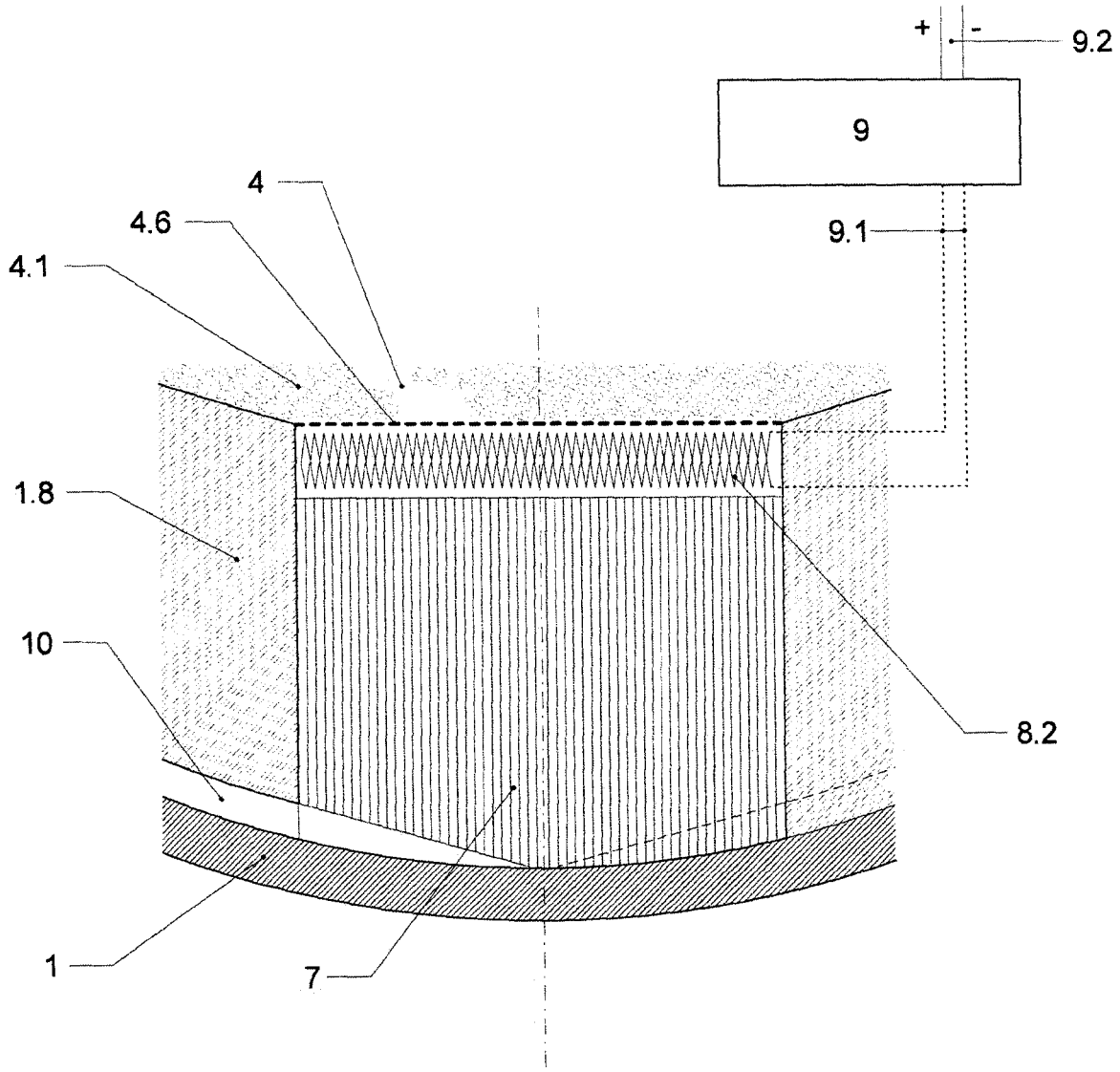
FIG. 3 illustrates a detail of an electric recuperator.

FIG. 3 illustrates a variant of an embodiment of the recuperator 7 with an electric heating element 8.2. In this embodiment, the electric heating element 8.2 is connected between the recuperator 7 and the gas working space, which is electrically connected by means of electrical wires 9.1 to a control unit 9, which is connected to a source 9.2 of electric voltage. The recuperator 7 further abuts the shaped parts 1.8 and is separated from the side of the gas operating space 4 by the second permeable membrane 4.6, wherein the second end of the recuperator 7 is connected to the external gas channel 10.

The function of the heat engine in this embodiment is as follows. The movement of the working gas within the gas working space 4 extends from the centre of the gas working space 4 to the inner shell of the pressure vessel 1 and vice versa. Filling of the gas working space 4 serves to ensure a uniform flow of the working gas within the working space and also due to the alternation of the flow direction of the working gas to the formation of a high temperature region 14 moving during the working phases in almost the entire volume of the gas operating space 4. Flow direction and rate of the working gas varies throughout all parts of the heat engine. Upon a request for pressure increase and compression in the liquid working space 5, the working gas flows from the pneumatic actuator 6 through the external gas channel 10 through the recuperator 7 and the heat exchanger 8.2 through the internal volume of the gas working space 4 into the circumferential gas channels 4.3. In this way, the average temperature of the working gas inside the device increases and there is an increase in pressure and expansion in the gas working chamber 4 and at the same time compression occurs in the liquid working space. With the request to reduce the pressure and expansion in the liquid working space, the working gas is conducted from the pneumatic actuator 6 through the internal gas channel 10.1 to the circumferential gas channels 4.3 disposed at the walls of the gas working space 4, further through the inner volume of the gas working space 4 and then through the heat exchanger 8 and recuperator 7. This reduces the average working gas temperature inside the device, and pressure reduction and compression occurs in the gas working space 4, while at the same time expansion occurs in the liquid working space. The liquid working space 5 reacts to the expansion and compression of the gas working space 4 with practically the same working pressure, the working space 5 decreases upon expansion of the liquid working space 4 at the same ratio; and the working space 5 increases upon compression of the gas operating space 4 at the same ratio. The engine performs work by changing the pressure and volume in the liquid working space 5. The sum of the volumes of both working spaces 4 and 5 is practically the same in all working phases. The engine in different operating phases is shown in FIGS. 1 and 2. In the case that the engine will operate at the inlet/outlet of the heat transfer medium 8.1 at temperatures lower than in the liquid working space, and in the case that the heat transfer medium will remove heat from the engine, the phases of expansion and compression will be reversed with respect to the direction of the internal flow of the working gas.

The inventive pressure vessel 1 with an internal heat exchanger in technical practice must resist only to normal temperatures at the outlet of the working gas from the recuperator 7 to the external gas channel 10.

Figure 4:
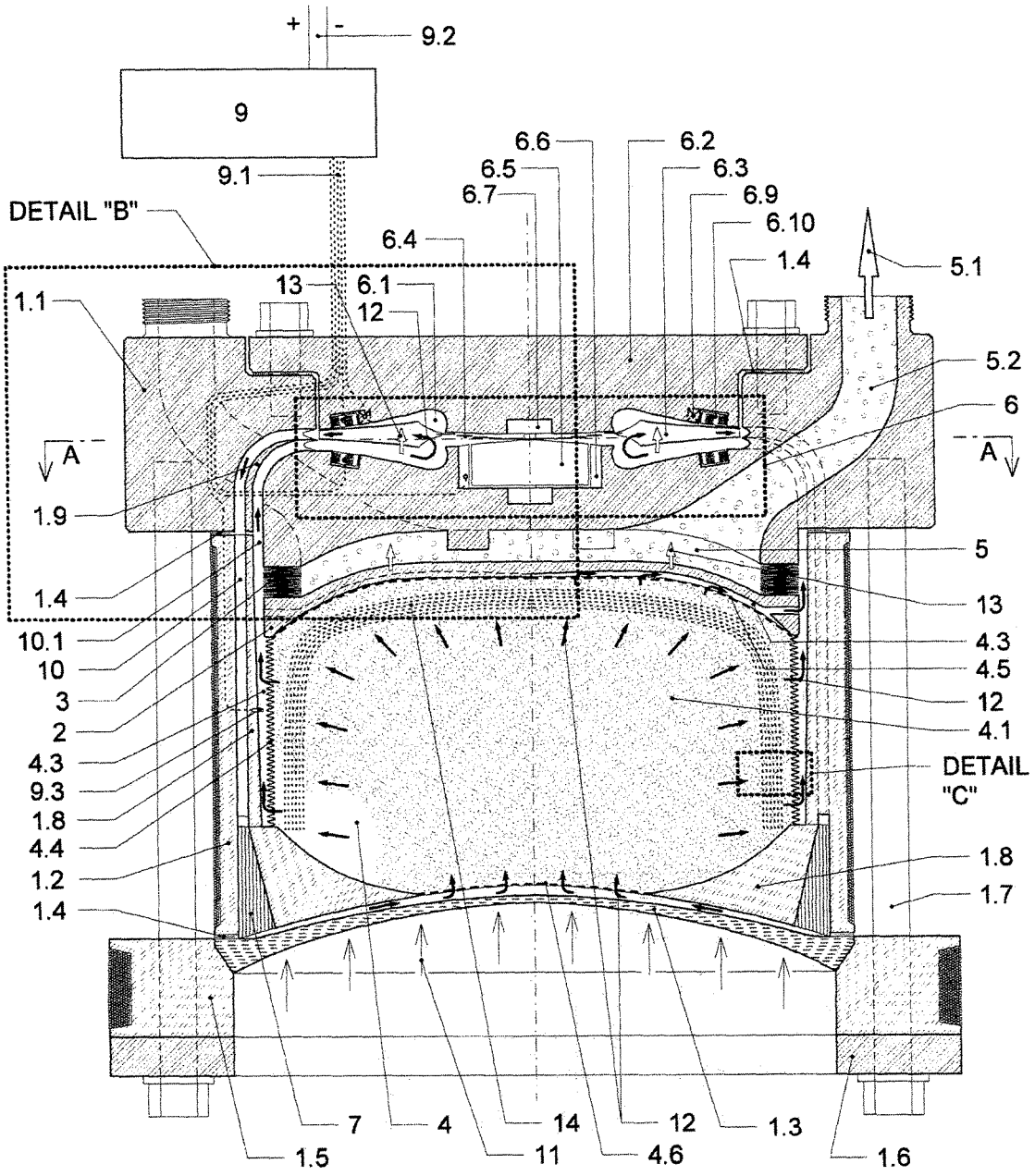
FIG. 4 illustrates an exemplary embodiment of a heat engine with an exchanger in the shell in the expansion phase.
Figure 5:
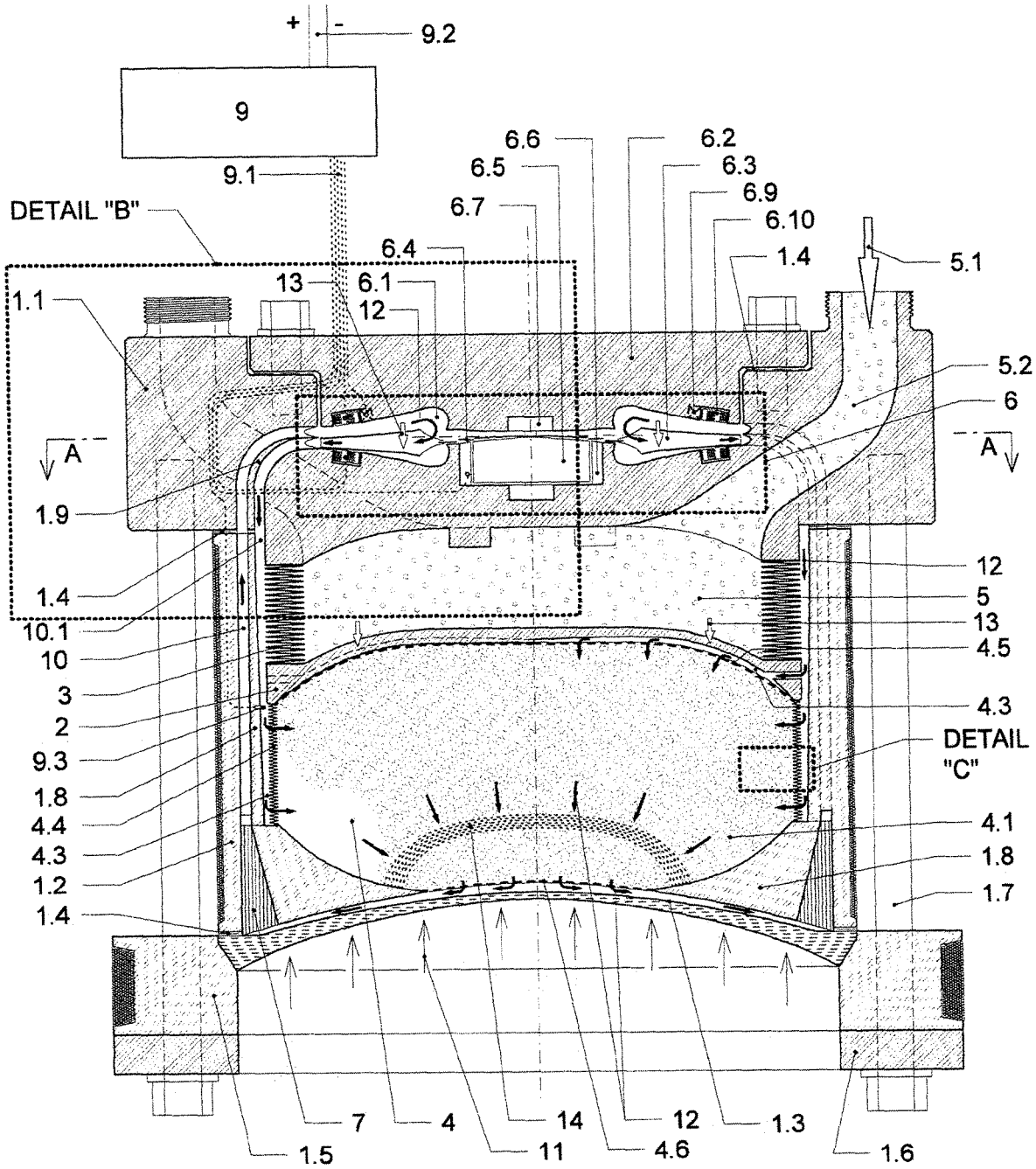
FIG. 5 illustrates an exemplary embodiment of a heat engine with an exchanger in the shell in the compression phase.

Another embodiment of a heat engine with a heat exchanger at the shell of a pressure vessel is illustrated in FIG. 4 and FIG. 5. This embodiment of the heat engine is different from the solution shown in FIG. 1 and FIG. 2. The embodiment differs in the design of the pressure vessel 1, which must in this case withstand high temperatures. The pressure vessel 1 consists of the following parts. A central part 1.2, which is disposed between a lid 1.1. and a ring 1.5. A central part 1.2 abuts a bottom 1.3 which is supported on the ring 1.5, wherein said ring is connected to the lid 1.1 by means of studs 17 which pass through the dispensing plate 1.6. Further, a seal 1.4 is provided between the lid 1.1 and the central part 1.2 and also the bottom 1.3 of the pressure vessel 1.

From the point of view of the efficiency of the heat engine, it is necessary that the abovementioned parts of the pressure vessel A be made of a material with the highest thermal resistance possible and at the same time with a mechanical strength that is capable of withstanding the changing internal pressure. Common materials that withstand high temperatures have solid crystalline atomic bonds but they withstand the cyclical effects of stress and relaxation only with difficulties. This load may in places of natural defects cause them to increase and thus gradually reduce the strength of such material. These loads also result from uneven heating of parts. Optimal design of parts loaded with high temperature ensures that they ate in constant pressure and do not create relaxation states with internal tensions. This can only be achieved by introducing additional pressure on the part by preloading it. This preloading should be introduced into these parts of the pressure vessel 1; into the central part 1.2, into the ring 1.5 and into the bottom 1.3. The ideal preloading material is carbon fibre, which is capable of transferring high tensile stress even at high temperatures. In the present embodiment, said parts of pressure vessel 1, such as the bottom 1.3 of the pressure vessel and the central part 1.2 of the pressure vessel 1, are designed as a composite of high tensile stress crystalline material at high temperatures and preloaded carbon fibres as a high tensile stress material at high temperatures. Moreover, the material of the bottom 1.3 of the pressure vessel 1 is also required to be of the highest thermal conductivity or energy permeability, especially for electromagnetic radiation, in respect to the function of its inner face as a heat exchanger. The ideal material for the bottom 1.3 of the pressure vessel is, in terms of thermal conductivity, for example, crystalline silicon carbide (SiC), or its modifications. In terms of energy permeability, sapphire glass ($Al_2O_3$) is the ideal material for the bottom of the pressure vessel.

The shell of the pressure vessel 1 adjacent to the external gas channel 10 can at the same time also serve as a heat exchanger and a heat recuperator in the variants of FIG. 1 and FIG. 2 as well as in the variant of FIG. 4 and FIG. 5, thereby complementing the function of the folded membrane 3 as a heat exchanger.

As can be seen from the accompanying drawings, the individual connected components of the heat engine are sealed using the seal 1.4. The lid 1.1 of the pressure vessel 1 is provided with an access to the pneumatic actuator 6 in the form of a service lid 6.2. In the case of a maintenance-free version of the pneumatic actuator 6 with magnetic bearings 6.8, it is possible to make joints on the service lid 6.2 as well as a permanent joint during production with higher impermeability.

In order to ensure the lowest possible hydraulic losses and quick engine reactions, large cross-sections of the liquid channels 5.2 are preferable. The liquid in the liquid working space 5 also serves as a cooling medium. As the power increases, liquid exchange in the liquid working space 5 increases as well, and so does also heat dissipation from the heat engine. In the design of the connection of the liquid channels 5.2 to the liquid working space 5, it is preferable to provide a support of the one-way circular flow of the internal liquid within the liquid working space 5 so as to maximize liquid exchange and transfer of heat to or from the folded membrane 3 in the liquid working space 5.

The largest area for cooling the working gas is the folded membrane 3, in addition to its surface; also its small thickness is advantageous. In an exchanger of such a design, the volume of the working gas bound in its space at the completion of the expansion phase reduces, which helps to increase the efficiency with minimal volume of the working gas outside the gas working space. The folded membrane 3 may be supplemented with other heat exchange surfaces and elements providing a greater flow around the entire surface thereof.

It is possible to modify the design with respect to a specific assignment of output dynamics, average power and peak performance requirements. Appropriate dimensioning of individual parts of the system can greatly enhance the required hydraulic output 5.1 characteristics. Upon requiring high dynamics and efficiency, the device can be designed with heat exchangers with a large heat transfer surface, optimal heat storage capacity in the recuperator 7. The recuperator 7 and heat exchangers should have the best ratio of pressure loss and efficiency. The higher power of the pneumatic actuator 6 and the cross-sections of the internal and external gas channels 10.1 and 10 can provide greater engine dynamics. For high dynamics, helium is also a preferred working gas.

Figure 6:
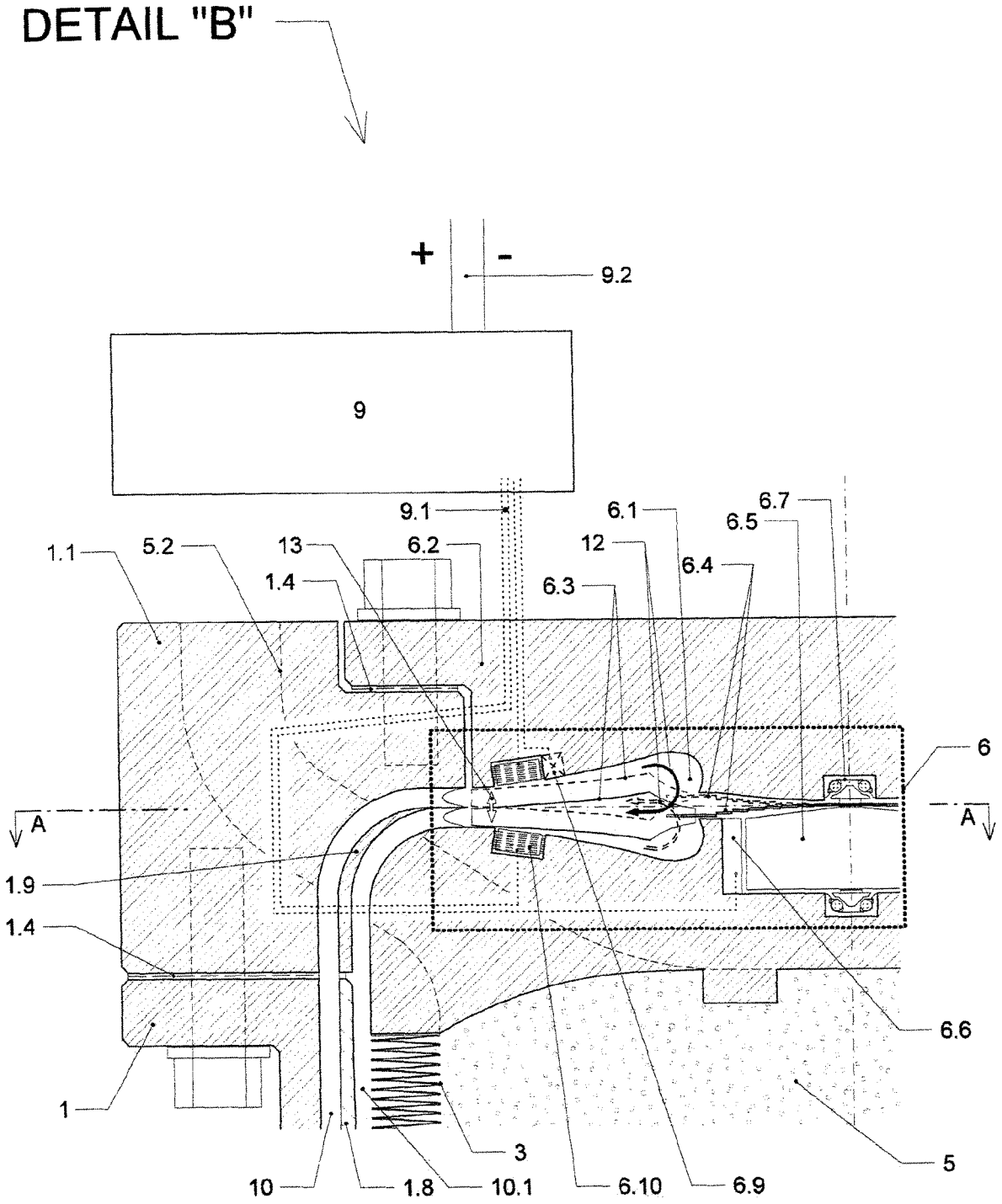
FIG. 6 illustrates a detail "B" of the embodiment of a gas actuator, in an embodiment with a roller bearing.
Figure 8:
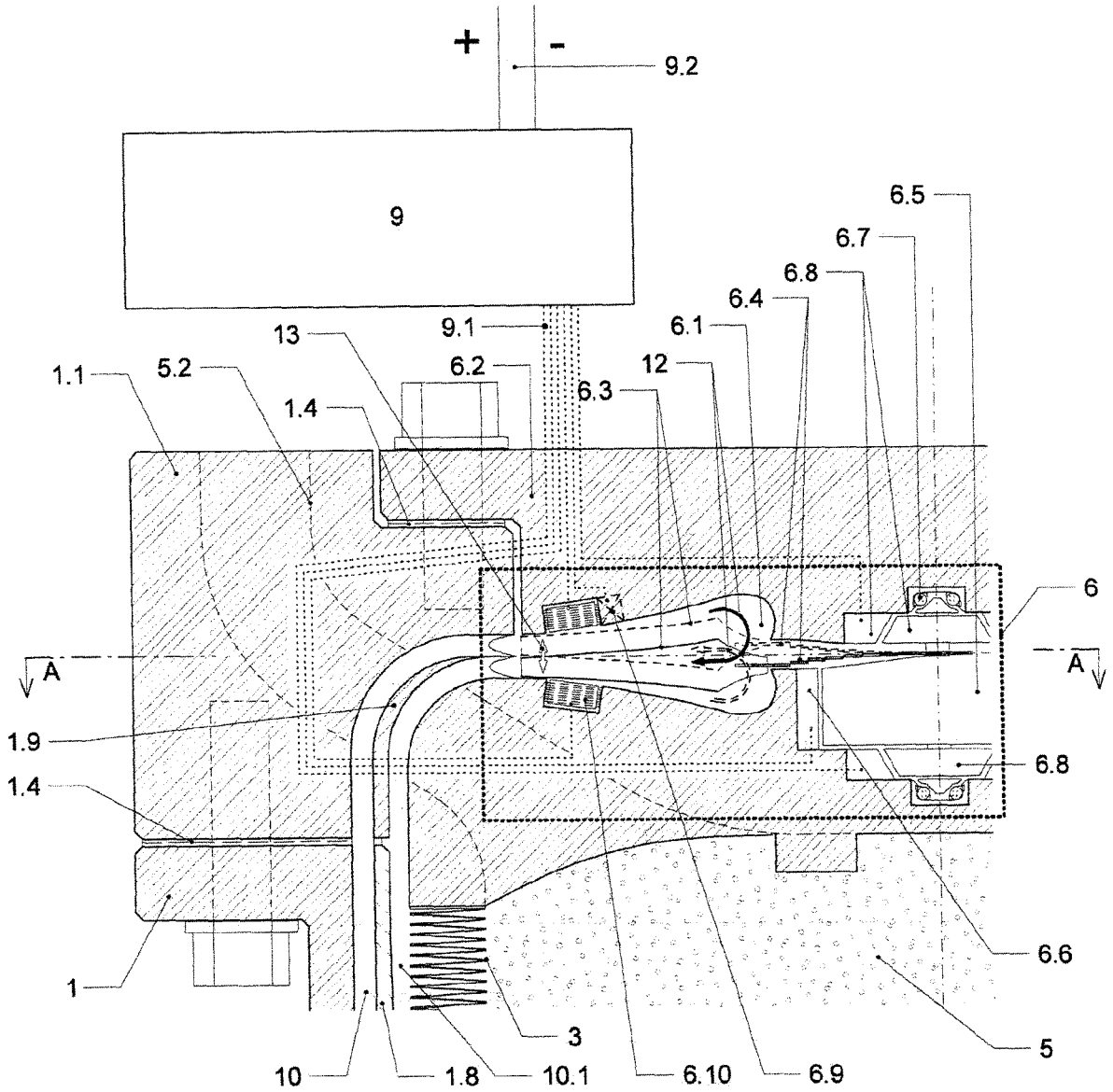
FIG. 8 illustrates a detail of the pneumatic actuator in the embodiment with the magnetic bearing.
Figure 9:
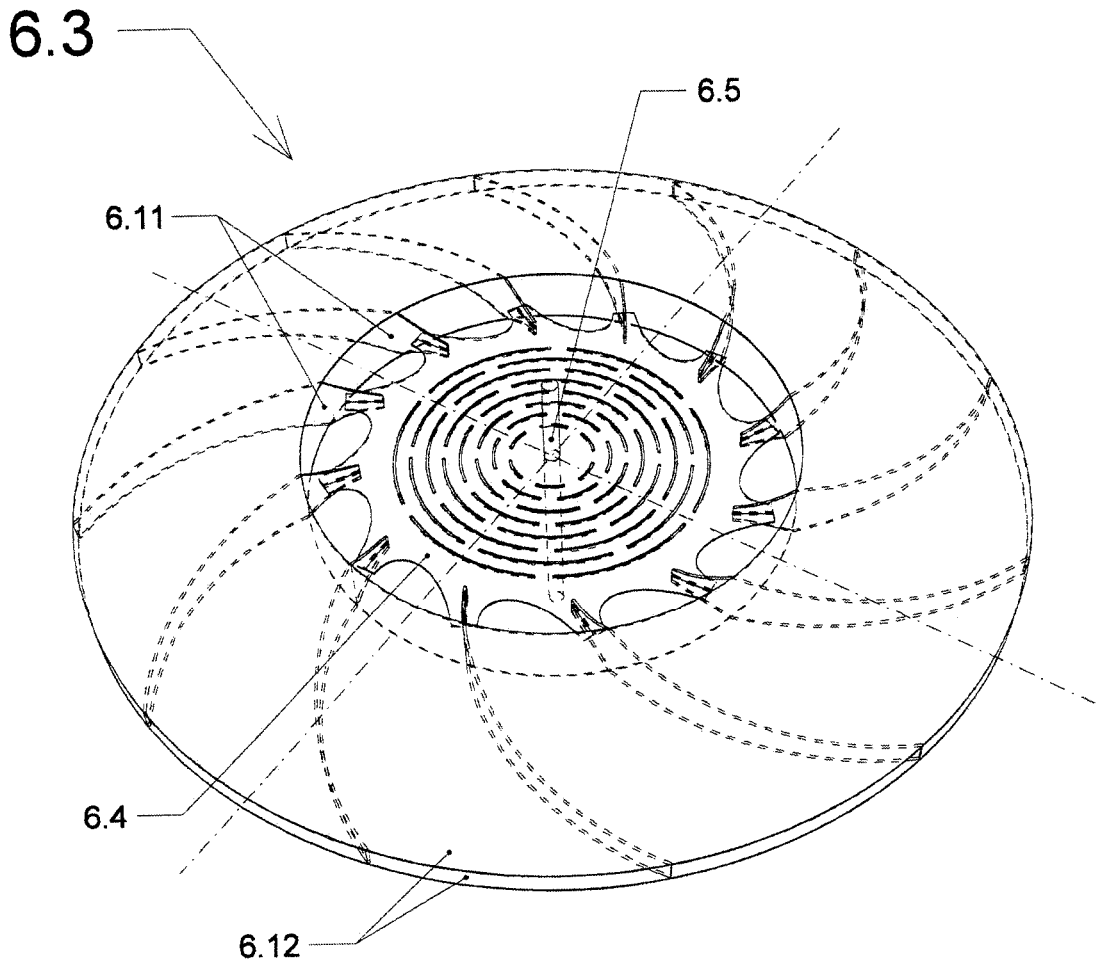
FIG. 9 illustrates the actuator impeller.

As can be seen from FIG. 1, FIG. 2, FIG. 4 and FIG. 5, the pressure vessel lid 1.1 of both of the heat engine variants described is identical. Details of an embodiment of the pneumatic actuator 6 in variants with different bearings are illustrated in FIG. 6 and FIG. 8. With this arrangement of the pneumatic actuator 6, a space is provided in the cover 1.1 for their placement. This space is covered by a service lid 6.2. A seal 1.4 is provided in the space between the service lid 6.2 and the lid 1.1. In this space, the stator 6.6 and the rotor 6.5 of an electric engine and the impeller 6.3 are arranged. The rotor 6.5 of the electric engine is stored in the magnetic bearing 6.8 and/or the ball bearing 6.7. The pneumatic actuator 6 comprises a chamber 6.1 and an impeller 6.3. The impeller 6.3 is secured to the rotor 6.5 shaft of the electric engine via a flat spring 6.4. An example of the impeller 6.3 is shown in FIG. 9. The impeller **6*b* in this embodiment consists in 'a flat spring 6.4 mounted on a rotor 6.5, which is connected to blades 6.11 which are reciprocally housed by gas rectifiers 6.12**.

Figure 7:
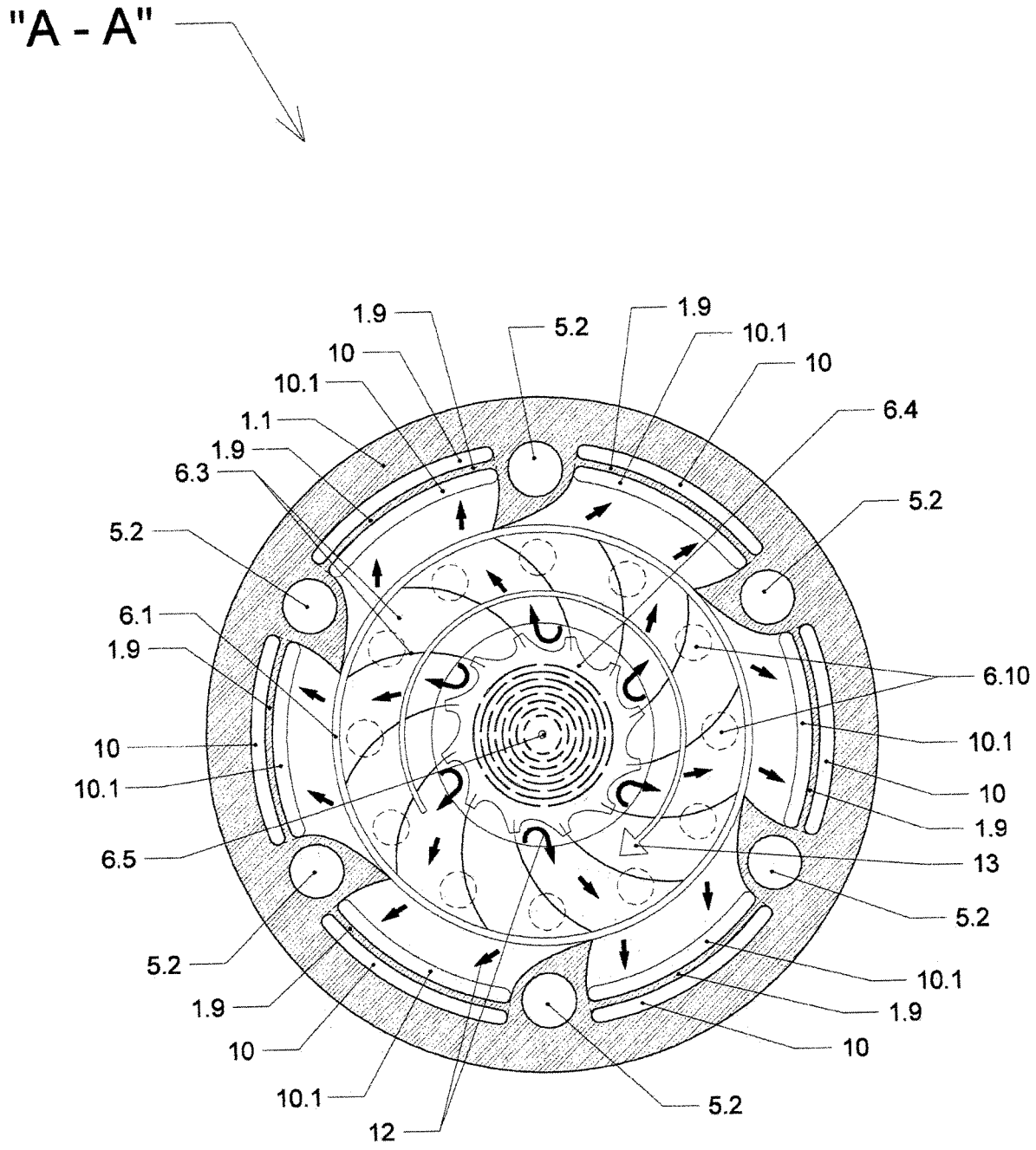
FIG. 7 illustrates a view of an A-A section of a pneumatic actuator.

FIG. 7 illustrates an A-A section through the lid 1.1 of the pressure vessel 1, in which the pneumatic actuator 6 is located. It is evident from the A-A section that there are liquid channels 5.2 in the cover 1.1 between which the internal gas channels 10.1 and the external gas channels 10 are separated by a partition 1.9. Inside the space of lid 1.1 of the pressure vessel 1 is formed a chamber 6.1. of the pneumatic actuator 6 in which the impeller 6.3 is arranged. In the space of the lid 1.1, electromagnets 6.10 which deflect the impeller are located in place above the blades of the impeller 6.3. In the middle of the lid 1.1 of the pressure vessel 1 is located, in its axis, a rotor 6.5 of an electric engine, which forms the axis of the impeller 6.3.

The pneumatic actuator 6 drives and controls the movement of the working gas. This is driven by a rotor 6.5 of an electric engine. The rotation speed rotor 6.5 of the electric engine determines the rate of movement of the working gas. The direction of movement 12 of the working gas is determined by the setting of the impeller 6.3 against a pair of the internal gas channel 10.1 and the external gas channel 10. The change of the setting of the impeller 6.3 is enabled by its elastic attachment to the rotor 6.5 of the electric engines. This resilient mounting allows the impeller 6.3 to deflect in a direction parallel to the axis of rotation. This deflection ideally, but not necessarily, is enabled by the flat spring 6.4 The deflection of the impeller 6.3 in the directions of the axis of rotation of rotor 6.5 can be achieved by means of electromagnets 6.10 but can also be carried out by electronically controlled magnetic bearings 6.8 by firmly coupling the impeller 6.3 with the rotor 6.5 of an electric engine. A position sensor 6.9 measures the actual position of the impeller 6.3 and serves as a feedback means for an electronic control unit 9 for controlling the movement of the impeller 6.3, Wherein the electronic control unit 9 is connected to electromagnets 6.10, magnetic bearings 6.8 and the stator 6.6 of an electric engine by means of electric wires 9.2. In an exemplary embodiment of a heat engine comprising a heat exchanger in its shell according to FIG. 4 and FIG. 5, a temperature sensor/sensors 9.3, preferably provided in the circumferential gas channels 4.3 at the inlet to the gas working space 4, are necessary for controlling the movement of the impeller and thermal protection of the device.

INDUSTRIAL APPLICABILITY

The device can be used as a dynamically controlled hydraulic pressure/volume source for hydraulic actuators with a thermal energy source and with no heed for hydraulic pumps and valves. It can be used wherever hydraulic drives are used and it is preferred for their faster operation and with higher efficiency while using a more available heat source.

In a regular cyclical mode of phase alternation, when the hydraulic output is replenished by two unidirectional valves, the device can serve as a high-pressure pump. The device can be used to gain mechanical work if there is enough thermal energy or in case of inability to use a normal source of motion energy, such as an electric engine, an internal combustion engine, etc. Great possibilities are offered, for example, for the direct transfer of solar energy to mechanical work. In technical practice, the employment of this solution offers wide applicability as a source of energy in the desalination of seawater by the reverse osmosis method.

LIST OF REFERENCE NUMERALS

1. pressure vessel
1.1 lid of the pressure vessel
1.2 middle part of the pressure vessel
1.3 bottom of the pressure vessel
1.4 sealing
1.5 ring
1.6 dispensing plate
1.7 pretensioned studs
1.8 shaped parts
1.9 channel partition
2. partition
3. folded membrane
4. gas working space
4.1 microstructure
4.2 mesh
4.3 circumferential gas channels
4.4 folded permeable membrane
4.5 first permeable membrane
4.6 second permeable membrane
4.7 hole
5. liquid working space
5.1 hydraulic inlet/outlet
5.2 liquid channel
6. pneumatic actuator
6.1 chamber
6.2 service lid
6.3 impeller
6.4 flat spring
6.5 rotor of the electric engine
6.6 stator of the electric engine
6.7 bearing
6.8 magnetic bearing
6.9 position sensor
6.10 electromagnet
6.11 blades
6.12 gas rectifiers
7. recuperator
8. heat exchanger
8.1 inlet/outlet of the heat transfer medium
8.2 electric heating element
9. electronic control unit
9.1 electrical wires
9.2 source of electric voltage
9.3 temperature sensor
10. external gas channel
10.1 internal gas channel
11. source of radiant energy
12. direction of movement of the working gas
13. direction of movement of the inner parts
14. high temperature gradient area

The invention claimed is:

1. A heat engine with a dynamically controlled outlet, driven by a high-pressure pump and a gas turbine comprising:

a pressure vessel having an inner space,
a lid,
a movable partition,
a gas working space,
a liquid working space, and
a recuperator,
characterized in that:

a sealing is disposed between the pressure vessel and the lid, wherein in the inner space of the pressure vessel, the partition is movably attached to a folded membrane which is further attached to the lid, wherein the partition divides the inner space of the pressure vessel into the gas working space and the liquid working space, wherein the gas working space occupies a larger area thereof, the gas working space being surrounded by a folded permeable membrane in the area of the first partition, and further, shaped parts are arranged within the pressure vessel, which define an external gas channel, wherein the external gas working channel is led between a shell of the pressure vessel and the shaped parts, a circumferential gas channel is located between the shaped parts and the folded membrane and further between a first permeable membrane and the partition, wherein the gas working space is filled with a micro structure made of a solid material with porosity higher than 99% of its volume, and is surrounded by a second permeable membrane to which a recuperator is connected, a heating exchanger being positioned within the recuperator and connected to an inlet and outlet of a heat transfer medium, wherein the recuperator is further surrounded by the shaped parts, and is separated from the gas working space by the second permeable membrane, the external gas channel is fed into space of the recuperator on the opposite side of its connection to the gas working space, wherein the external gas channel is connected to a pneumatic actuator chamber, into which is further fed an inner gas channel, connected to the circumferential gas channel.

2. The heat engine according to claim 1, characterized in that the pneumatic actuator comprises a stator and a rotor of an electric engine and a chamber in which an impeller is positioned with blades and gas rectifiers, wherein the impeller is connected to a shaft of the rotor of the electric engine by means of a flat spring, wherein the rotor of the electric engine is housed in a magnetic bearing or a bearing.

3. The heat engine according to claim 1, characterized in that, the shell of the pressure vessel constitutes a middle part, which is disposed between the lid and a bottom, wherein the bottom abuts a ring, which is disposed on a dispensing plate, wherein the dispensing plate is connected to the lid by means of studs and further the sealing is disposed between the lid, the middle part and the bottom.

4. The heat engine according to claim 1, characterized in that the microstructure (4.1) is a material with porosity higher than 99% based on its overall volume, with density from $1\times10^{-4}$ to 0.03 g $cm^3$.

5. The heat engine according to claim 1 characterized in that the micro structure is selected from one of group consisting of:

carbon, ceramic, metal microfibers, nano-fibers, aerographite, and graphite aerogel.

6. The heat engine according to claim 1, characterized in that the folded membrane (3) is impermeable to gas.

7. The heat engine according to claim 1, characterized in that the micro structure is disposed between meshes arranged at a distance from each other, wherein the meshes are disposed in planes perpendicular to a motion vector of the partition, which are connected to the folds of the folded permeable membrane.

8. The heat engine according to claim 7, characterized in that the meshes are formed of carbon, ceramic or metal fibers, wherein mutual distance of the meshes and mesh fibers in the plane thereof are in the range of 100 to 10,000 times the mean distance of the micro structure elements.

9. The heat engine according to claim 4 characterized in that the micro structure is selected from one of group consisting of:

carbon, ceramic, metal microfibers, nano-fibers, aerographite, and graphite aerogel.

* * * * *